US005566651A

United States Patent [19]

Strauss et al.

[11] Patent Number: 5,566,651

[45] Date of Patent: Oct. 22, 1996

[54] DEVICE FOR CONTINUOUS ANGULAR ADJUSTMENT BETWEEN TWO SHAFTS IN DRIVING RELATIONSHIP

[75] Inventors: Andreas Strauss, Herzogenaurach; Eduard Golovatai-Schmidt, Nuremberg, both of Germany

[73] Assignee: Ina Walzlager Schaeffler KG, Germany

[21] Appl. No.: 325,245

[22] PCT Filed: May 5, 1993

[86] PCT No.: PCT/EP93/01091

§ 371 Date: Oct. 18, 1994

§ 102(e) Date: Oct. 18, 1994

[87] PCT Pub. No.: WO93/24736

PCT Pub. Date: Dec. 9, 1993

[30] Foreign Application Priority Data

Jun. 1, 1992 [DE] Germany ..... 42 18 082.1

[51] Int. Cl.[6] ..... F01L 1/344

[52] U.S. Cl. ..... 123/90.17; 123/90.31

[58] Field of Search ..... 123/90.15, 90.17, 123/90.31; 74/567, 568 R; 464/1, 2, 160

[56] References Cited

U.S. PATENT DOCUMENTS

| | | | |
|---|---|---|---|
| 5,012,773 | 5/1991 | Akasaka et al. | 123/90.17 |
| 5,144,921 | 9/1992 | Clos et al. | 123/90.17 |
| 5,189,999 | 3/1993 | Thoma | 123/90.17 |
| 5,301,639 | 4/1994 | Satou | 123/90.17 |

FOREIGN PATENT DOCUMENTS

| | | |
|---|---|---|
| 0112644 | 7/1984 | European Pat. Off. . |
| 0296885 | 12/1988 | European Pat. Off. . |
| 0335083 | 10/1989 | European Pat. Off. . |
| 0340821 | 11/1989 | European Pat. Off. . |
| 855158 | 5/1940 | France . |

*Primary Examiner*—Weilun Lo
*Attorney, Agent, or Firm*—Bierman and Muserlian

[57] ABSTRACT

The invention concerns a device for continuous angular adjustment between at least two shafts, a crankshaft and a camshaft of an internal combustion engine, in driving relationship particularly, comprising an adjusting element (4) which is connected to a shaft to be adjusted while being arranged in an axial direction thereto and comprising a hydraulically actuatable piston (14) which is connected to a pressure medium circuit, characterized in that an end region of the shaft to be adjusted, which can be the camshaft (5) or an intermediate shaft, is surrounded by a fixed connecting plate (8*a*,8*b*) which comprises pressure medium ducts (6,7) for pressure medium supply to the adjusting element (4).

12 Claims, 3 Drawing Sheets

DEVICE FOR CONTINUOUS ANGULAR ADJUSTMENT BETWEEN TWO SHAFTS IN DRIVING RELATIONSHIP

STATE OF THE ART

It is known to use such a device in internal combustion engines with which valve timings can be adapted to engine operation to obtain an optimum operation of the engine in the largest possible speed range. By this, improvements with regard to torque, performance, exhaust gas emission, idling behavior and fuel consumption can be obtained.

A valve control for inlet valves is known from the species defining document, EP-OS 03 35 083, in which the inlet camshaft can be adjusted with the help of a phase transformer. An adjusting element is mounted for axial displacement and comprises an exclusively hydraulically actuatable piston which is associated with two working chambers and controlled by an adjusting piston of a directional control valve. This adjusting piston is displaced between two discrete end positions by a solenoid switch which is arranged on the longitudinal axis of the camshaft and therefore increases the axial design space requirement of the engine. This construction, and particularly the control valve, permits only a two-point adjustment of the inlet camshaft. The extra design space required due to the chosen arrangement of the solenoid is disadvantageous particularly when the engine is installed crosswise which is general current practice in passenger cars with front wheel drive.

EP-OS 01 12 494 describes another camshaft adjusting device which comprises a hydraulically actuatable piston. The device has a circular ring-shaped configuration and is provided with an internal and an external gearing, one of these gearings being a helical gearing. An axial displacement of the piston due to application of a pressure medium effects a phase shift between the components connected to the piston by the gearings, i.e. a camshaft drive pinion and a component connected indirectly to the camshaft. Disadvantageously, this solution requires a pressure medium supply through the mounting of the camshaft and a bore extending axially in the camshaft. Pressure medium is discharged from the adjusting device at an axial end thereof through a housing of the adjusting device. This advantageously necessitates a modification of the camshaft. A further disadvantage is the larger overall axial length of the engine.

An adjusting device described in DE-A 39 29 621 comprises a shaft member which is flange-mounted on an end of a camshaft, the adjusting device being integrated in this shaft member which forms an extension of the camshaft. Pressure medium supply is effected through bores extending radially upto the shaft member in a mounting region. Due to the configuration of this device, there results an adjusting piston with relatively small piston areas so that the adjusting forces of the device dependent thereon are likewise small. Moreover, the radial design space requirement of this adjusting device is relatively large due to the fact that the adjusting element and the pressure medium supply are arranged in one and the same housing.

OBJECTS OF THE INVENTION

The object of the invention is to provide an adjusting device which is separate from the camshaft mounting, which does not have an adverse effect on the strength of the camshaft and in which the pressure medium supply is substantially separate from the adjusting element for assuring an optimized application of pressure chambers, with, at the same time, a limited radial design space requirement.

This and other objects and advantages of the invention will become obvious from the following detailed description.

THE INVENTION

A device for continuous angular adjustments between at least two shafts in driving relationship, particularly a crankshaft and a camshaft of an internal combustion engine, comprising an adjusting element (4) which is connected to a shaft to be adjusted while being arranged in an axial direction thereto and comprising a hydraulically actuatable piston (14) which is connected to a pressure medium circuit, characterized in that an end region of the shaft to be adjusted, which can be a camshaft (5) or an intermediate shaft, is surrounded by a fixed connecting plate (*8a,8b*) which comprises pressure medium ducts (6,7) for pressure medium supply to the adjusting element (4).

The device of the invention comprises a connecting plate which is fixed on a cylinder head or a housing and radially surrounds the shaft to be adjusted, i.e. a camshaft or an intermediate shaft, while being fixed against rotation and comprising ducts for the supply of pressure medium to the adjusting element. Thus, advantageously, the pressure medium required for the axial displacement of the adjusting elements does not have to be transferred to the adjusting element via the camshaft mounting nor axially through the camshaft, and the pressure medium ducts do not have to be connected to the device at the front end thereof. In this way, an adjusting device is obtained which is separate from the camshaft mounting and does not have an adverse effect on the strength of the camshaft. Advantageously, the connecting plate is configured to extend over the radial design space of the adjusting element thus permitting a protected arrangement of the ducts which at the same time is conducive to assembly, the resulting adjusting device being optimized with regard to design space requirement particularly in the radial direction. Further, the connecting plate comprising pressure medium ducts permits a pressure medium supply with favorable flow characteristics to the pressure chambers in which the piston is guided for axial displacement.

According to the further feature of the invention, the connecting plate is arranged at an end of the housing, preferably the cylinder head housing or the crankcase. Alternatively, it is also possible to fix the connecting plate inside the housing or the cylinder head and thus further reduce the overall axial dimension of the device of the invention. Further, this solution offers a protected arrangement of the pressure medium ducts since they advantageously extend within the housing of the internal combustion engine and can be connected there to the connecting plate.

In an advantageous development of the invention, the rigid arrangement of the connecting plate is provided within the cylinder head or the crankcase, the connecting plate being arranged spaced from the wall of the cylinder head housing so that no machining is required for forming an axial bearing surface on the housing wall. The connecting plate is positionally fixed on the cylinder head by a screw connection which necessitates only a local machining of the contact region between the connecting plate and the cylinder head.

The adjusting element comprises an axially displaceable piston which is inserted between a housing and a bushing which forms an axial extension of the shaft. The piston is comprised of a sleeve and a piston plate which separates the pressure chambers from one another and is arranged unrotatably radially of the sleeve on an end thereof. The sleeve comprises an external and an internal gearing which form gear pairs with appropriately geared components which are a hub located within the sleeve and connected to the housing and a ring which is formed in one piece with the bushing and coaxially surrounds a part of the piston. Advantageously, the adjusting element is lodged in a housing which is mounted on a bushing which forms an extension of the camshaft, and the outer periphery of the housing comprises a drive pinion. The housing is mounted for rotation on the bushing by a hub and comprises a recess in which, inter alia, the pressure chambers and the piston, to which pressure can be applied at both ends, are lodged. Torque transmission between the housing and the camshaft is effected by means of the axially displaceable piston which is connected by the helical gear pairs both to the bushing and the housing. The supply of pressure medium for the axial displacement of the piston which effects an angular displacement between the housing and the camshaft is assured by the connecting plate of the invention which comprises the ducts for pressure medium supply and discharge.

According to another feature of the invention, the pressure medium for the application of pressure to the pressure chambers is transferred, depending on the adjusting stroke of the piston, through one of two gear pairs. This results in an advantageously efficient noise attenuation of the meshed gears whose flanks collide alternatively with one another in rapid succession due to the changing camshaft torque. Advantageously, according to the invention, the larger of the two gear pairs, to which the camshaft is connected, is adequately penetrated by the pressure medium to assure efficient noise attenuation. This gear pair does not comprise a damping member in contrast to the other gear pair to which the piston is connected and whose inertia attenuates the impact of the gear flanks on one another. The pressure medium supply guarantees a permanent application of pressure medium to the gear flanks and this has an advantageous effect on the noise level. The pressure medium supply according to the invention further effects a desired, efficient lead-off of air into the oil circuit.

Advantageously, the helices of the gear pairs are differently oriented and adapted to the diameters of the components concerned so that the largest possible adjusting range can be obtained even with a slight axial displacement of the piston.

In a further development of the invention, the adjusting stroke of the piston is limited in both axial directions by stops arranged in a region of the outer periphery of the piston plate to bear against the inner surface of the housing.

In a further advantageous development of the invention, a pressure spring is arranged between the piston plate and the stop located nearer the connecting plate. By using a conical pressure spring, the spring length can be advantageously increased if the wider region of the pressure spring facing the connecting plate is made to surround the components situated interiorly thereof so that the pressure spring can extend through almost the entire axial length of the housing. Alternatively, it is also possible according to the invention to inverse the arrangement of the pressure spring. To obtain a defined position of installation, the pressure spring is guided by a stepped stop or cover at its ends nearer the connecting plate and bears at its other end in the region of the hub against the piston plate.

In the region of overlap between the rigidly mounted connecting plate and the rotating bushing, there are provided oil passages, for example in the form of an annular or a circumferential groove of the bushing which corresponds with appropriately located through-bores of the connecting plate which open into the region of the annular groove and are sealed on either side of the oil passage by radially pre-tensioned steel sealing rings. This type of sealing which is designed also for high rotational speeds guarantees a wear-resistant and stable sealing with the advantage that the sealing compensates any relative displacements between the rotating bushing and the rigidly arranged connecting plate.

The adjusting device of the invention can be advantageously used both on inlet and outlet camshafts. It is likewise possible to use the adjusting device of the invention on an intermediate shaft disposed on an engine between the crankshaft and the camshafts, in which case the intermediate shaft is driven by the crankshaft. The intermediate shaft comprising the adjusting device of the invention permits both a continuous and a two-point adjustment of the camshaft arranged behind it in the drive train. This solution can be advantageously used for example in V-type engines. The association of the adjusting device of the intermediate shaft results in a simultaneous shifting of the timings of the inlet and outlet valves so that valve lap remains unchanged. The configuration of the spring and the gear orientation of the gear pairs permit an alternative pre-setting of the end positions "advanced" or "retarded" in the quiescent condition. The optimized overall dimensions of the adjusting device are conceived so that the radial design space requirement is smaller than or equal to the space available within the drive pinion of a rigid camshaft drive.

Advantageously, the configuration of the adjusting device of the invention is rotationally symmetrical whereby cost-effective fabrication by chipless shaping or turning is possible and, moreover, no special angular alignment is required in assembling the device.

BRIEF DESCRIPTION OF THE DRAWINGS

FIG. 1 is a cross-sectional representation of the adjusting element (4) which is fixed on an end of the camshaft (5) which in turn is mounted via a sliding bearing (58) in the housing (52), preferably of a cylinder head (2). The adjusting element (4) can be likewise combined with an intermediate shaft arranged between a crankshaft and a camshaft. Coincident with the end face (59) of the housing (52), the camshaft (5) comprises a shoulder (60) onto which a bushing (13) comprising a stepped bore is pushed and rigidly connected to the camshaft (5) by the screw (45). The housing (29) mounted via the hub (23) on the bushing (13) comprises a pinion (49) on its outer periphery. The housing (29) further comprises a circular ring-shaped recess (30) into which, inter alia, the piston (14) is inserted. This piston (14), which is shown in FIG. 1 in both its end positions, is comprised of the sleeve (15) and the piston plate (17) fixed against rotation on an end thereof. On its inner surface, the sleeve (15) comprises a helical gearing which forms a gear pair (18) with an external gearing arranged on the hub (23) of the housing (29). An external helical gearing arranged on the end of the sleeve (15) away from the piston plate (17) forms a gear pair (19) with an appropriate internal helical gearing arranged on the ring (21) which is made in one piece with the bushing (13) and coaxially surrounds the sleeve (15). A gap seal (39) is formed between the bushing (13) and a radially inwards oriented projection of the sleeve (15) arranged on an end thereof. The stroke of the axially displaceable piston (14), whose piston plate (17) separates the pressure chambers (11) and (12) from one another, is limited by circular ring-shaped stops (25,26) which, in the end positions of the piston, bear against the radially outer periphery of the piston plate (17). The stop (25) has the further function of sealing the pressure chamber (12) at its end nearer the connecting plate (8*a*). For this purpose, a sealing ring (63) and a sealing ring (64) are inserted between the stop (25) and the housing (29) and between the stop (25) and the ring (21) respectively. The axial fixing of the stop (25) is assured by a retainer (62). A conical pressure spring (24) is inserted between the stop (25) and the piston plate (17) and serves to displace the piston (14) against the stop (26) in the pressureless state.

In FIG. 2, the piston (14) bears against a stop opposed to that of FIG. 1. To displace the piston (14) into this position, it is necessary to feed a pressure medium into the adjusting element (4) through the duct (6) which, similar to the duct (7), is arranged radially on the connecting plate (8*a*) which is connected to the end face (59). The pressure medium is transferred through the bore (68) of the connecting plate (8*a*), further through the bores (55,56) and the circumferential groove (67) of the bushing (13) into the cross-cut which extends axially parallel to the screw (45) upto the disc (65). Several radial bores 61 and a circumferential groove (50) establish a connection between the cross-cut (57) and the pressure chamber (11). To facilitate the flow of the pressure medium from the bore (61) through the gear pair (18) to the pressure chamber (11), individual teeth are omitted in the gear pair (18). For pressurizing the pressure chamber (12) to obtain the position of the piston (14) shown in the upper half of FIG. 1, pressure medium is fed through the duct (7). The pressure medium is transferred through the bores (69,54), the annular groove (53) and a tap bore (66) of the housing (29), further through the gear pair (19), in which again individual teeth are omitted to improve flow, and finally into the pressure chamber (12). On either side of the passage for pressure medium flow from the connecting plate (8*a*) to the rotating component, there is provided a sealing ring (9,10) in the form of a radially pretensioned steel ring arranged in an annular groove of the bushing (13).

Figure 1:
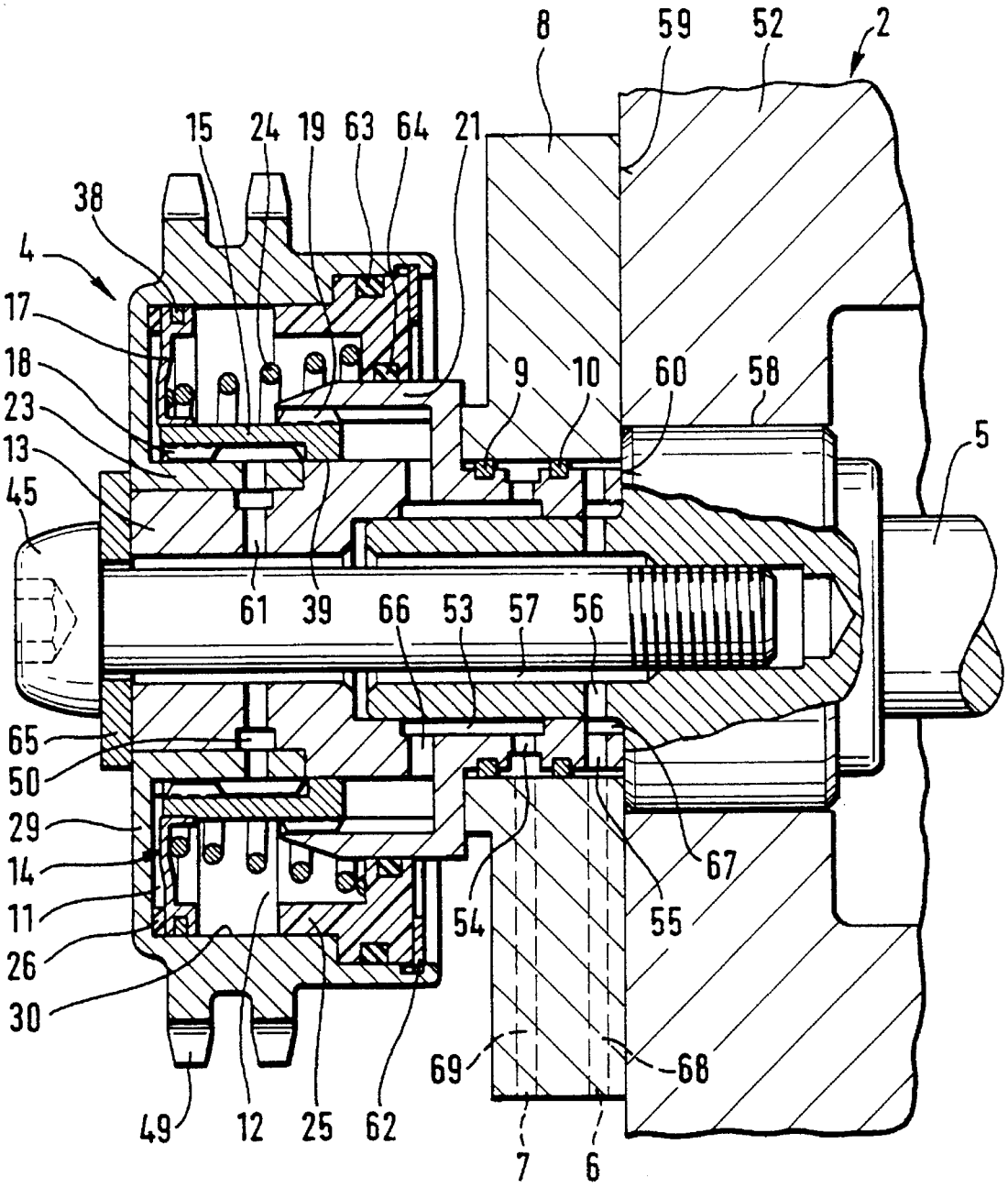
FIG. 1 is an axial cross-section of an adjusting device of the invention in which a connecting plate comprising the pressure medium duct is arranged between a housing and the adjusting element.
Figure 2:
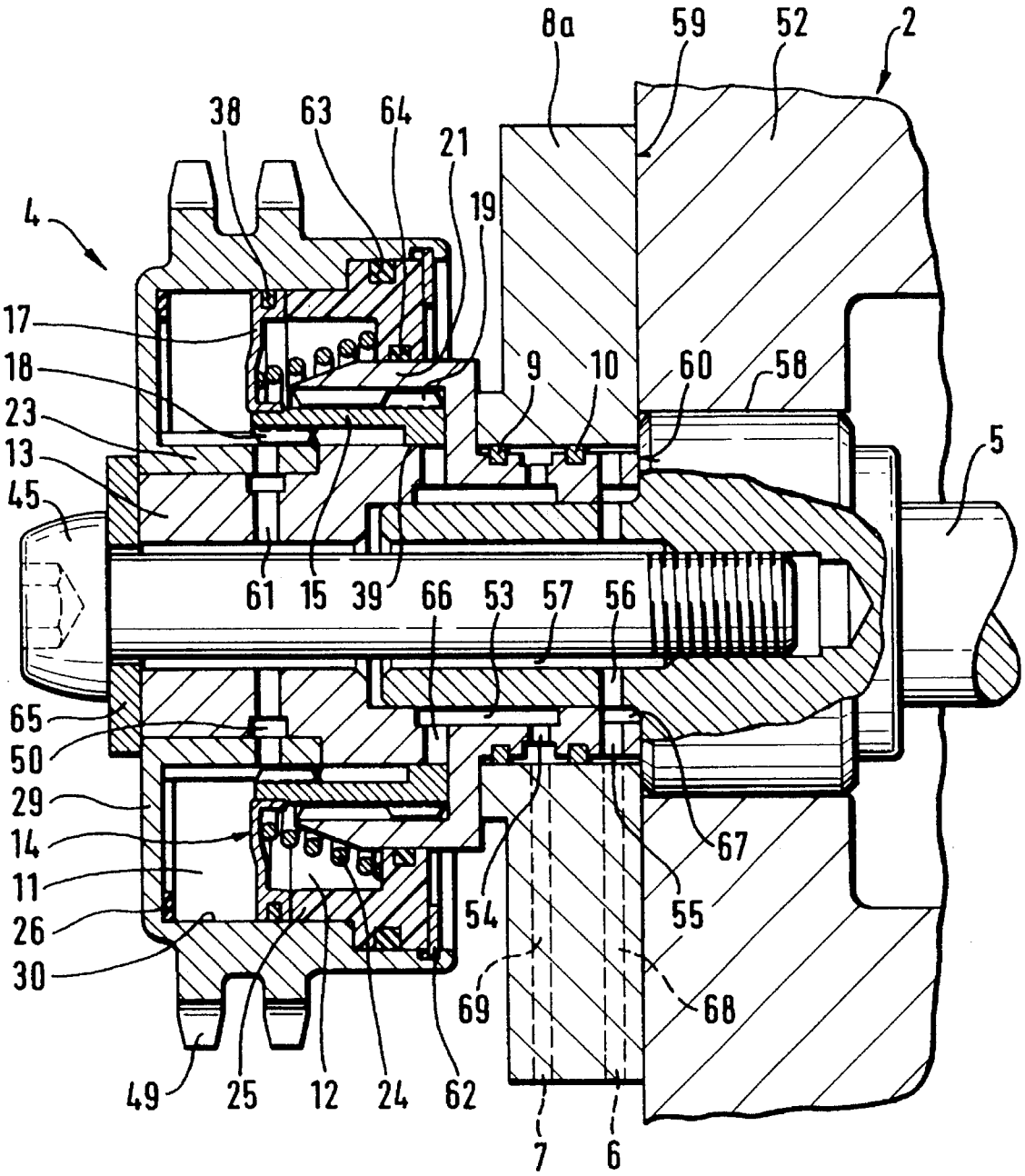
FIG. 2 shows the piston of FIG. 1 on an end position displaced with respect to the cylinder head and FIG. 3 shows an adjusting device corresponding to that of FIG. 1 but with the connecting plate disposed within the housing.

The sealing of the piston plate (17) on the housing (29) is assured by the piston ring (38) which is inserted into an annular radial groove on the outer periphery of the piston plate (17). The adjusting element (4) is configured so that the driving impulse, for example from a chain drive, acts on the pinion (49) which is rigidly connected to the housing (29).

Mode of operation of the adjusting element on FIG. 1

When the pressure in the pressure chamber (11) is increased, the piston (14) overcomes the force of the pressure spring (24) and is displaced towards the stop (25). Due to the helical gearing of the gear pair (18), the displacement of the piston (14) is accompanied by a relative rotation between the piston (14) and the hub (23), and by this, also between the piston (14) and the housing (29). By the action of the gear pair (19), by which the piston (14) is connected to the ring (21), a synchronous, boostering relative rotation takes place between the bushing (13), which is made in one piece with the ring (21), and the camshaft (5) and effects a change in the angular position of the driving element, i.e. the pinion (49), relative to the camshaft (5).

Figure 3:
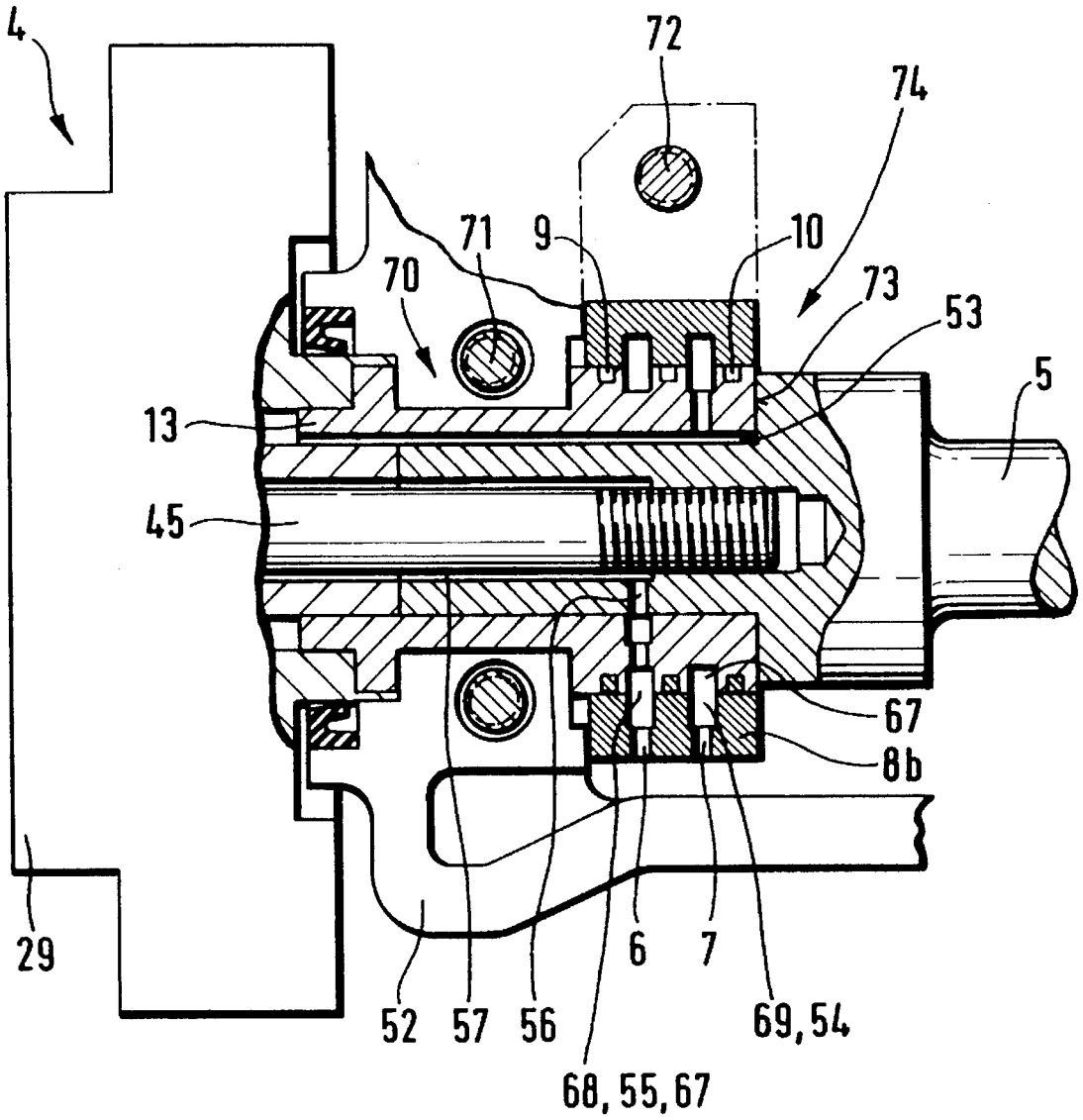

In the second embodiment of the invention shown in FIG. 3, the same reference numbers have been used as in FIG. 1 to identify parts that are in common with the first embodiment so that reference may be made to the description of FIG. 1.

However, in contrast to FIG. 1, the adjusting element (4) is shown as bearing almost directly against the housing (52). In this embodiment, the design space requirement of the adjusting element (4) is further reduced by arranging the connecting plate (8*b*) within the housing (52), preferably in the mounting space of the camshaft (5). In this construction, a bushing (13) starting from the adjusting element (4) extends into the mounting space (74) of the camshaft (5) and bears against a shoulder (73) of the camshaft (5). A mounting arrangement (70) in the form of a mounting cap, not shown, which is fixed to the housing (52) by mounting screws (71) serves to mount and axially fix the bushing (13). At its end nearer the camshaft (5), the bushing (13) comprises a radial extension which is inserted into and substantially overlapped axially by the connecting plate (8*b*). An end of the camshaft (5) is inserted into the bushing (13), and the camshaft (5), which likewise comprises a radial extension, bears by the shoulder (73) against the bushing (13). To obtain a non-rotating mounting of the connected plate (8*b*), this is positionally fixed in the housing (52) by a screw (72) while being spaced from the outer housing wall. At a location opposite the screw (72), the connecting plate (8*b*) comprises ducts (6,7) for pressure medium supply and discharge from the adjusting element (4), the ducts being advantageously arranged inside the housing (52). Pressure medium is transferred from the ducts (6,7) via a bore, a circumferential groove, a tap bore, a cross-cut or longitudinal bore of the connecting plate (8*b*) and the bushing (13) etc. into one of the pressure chambers (11,12) as described in detail in connection with FIG. 1.

We claim:

1. A device for continuous angular adjustment between at least a crankshaft and a camshaft of an internal combustion engine in driving relationship comprising an adjusting element (4) which is connected to a shaft to be adjusted while being arranged in an axial direction thereto and comprising a hydraulically actuatable piston (14) which is connected to a pressure medium circuit, characterized in that a separate connecting plate (8*a*, 8*b*) fixed on a cylinder head (2) is associated with the adjusting element (4), and said connecting plate radially surrounds the camshaft which is to be adjusted, the connecting plate (8*a*, 8*b*) comprising pressure medium ducts (6,7) for pressure medium supply to the adjusting element (4).

2. A device of claim 1 wherein the connecting plate (8*a*) is arranged on a front end of the cylinder head (2) of the internal combustion engine.

3. A device of claim 1 wherein the connecting plate (8*b*) is arranged within the cylinder head (2) on an inner surface thereof.

4. A device of claim 3 wherein the connecting plate (8*b*) is arranged to be fixed against rotation and spaced from an outer wall of the cylinder head (2).

5. A device of claim 1 wherein the piston (14) is axially displaceable between a housing (29) and a bushing (13) and comprises a sleeve (15) and a piston plate (17) which separates two pressure chambers (11, 12) from one another, the sleeve (15) comprising a helical gearing on an inner surface thereof and a further helical gearing on an outer surface thereof.

6. A device of claim 5 wherein pressure medium for application of pressure to the pressure chambers (11, 12) is transferred, depending on the direction of an adjusting stroke of the piston (14), through one of two gear pairs (18, 19).

7. A device of claim 6 wherein helices of the two gear pairs (18, 19) are differently oriented.

8. A device of claim 5 wherein the adjusting stroke of the piston (14) is limited by stops (25, 26) which, in respective end positions of the piston (14), bear against a region of an outer periphery of the piston plate (17).

9. A device of claim 8 wherein a conical helical pressure spring (24) is inserted between one of the stops (25) and the piston plate (17), the pressure spring (24) widening towards one of the stops (25).

10. A device of claim 1 wherein an oil passage comprising sealing rings (9, 10) on either side thereof are arranged between the connecting plate (8) and a bushing (13).

11. A device of claim 10 wherein the sealing rings (9, 10) compensate any misalignments between the connecting plate (8) and the bushing (13).

12. A device of claim 1 wherein all components of the adjusting element (4) are rotationally symmetrical and no special angular orientation is required for assembly.

* * * * *